US009784491B2

(12) United States Patent
Choi

(10) Patent No.: US 9,784,491 B2
(45) Date of Patent: Oct. 10, 2017

(54) DRIVING DEVICE FOR AUTOMATIC ICE-MAKING MACHINE

(71) Applicant: SCD CO., LTD., Gyeonggi-do (KR)

(72) Inventor: Jae Hyeong Choi, Gyeonggi-do (KR)

(73) Assignee: SCD CO., LTD., Yongin-si, Gyeonggi-do (KR)

( * ) Notice: Subject to any disclaimer, the term of this patent is extended or adjusted under 35 U.S.C. 154(b) by 677 days.

(21) Appl. No.: 13/789,758

(22) Filed: Mar. 8, 2013

(65) Prior Publication Data

US 2013/0233010 A1 Sep. 12, 2013

(30) Foreign Application Priority Data

Mar. 9, 2012 (KR) ..... 10-2012-0024416

(51) Int. Cl.

| | |
|---|---|
| ***F25B 49/00*** | (2006.01) |
| ***F25D 21/02*** | (2006.01) |
| ***G01K 13/00*** | (2006.01) |
| ***F25C 5/18*** | (2006.01) |
| ***F25C 1/00*** | (2006.01) |

(52) U.S. Cl.

CPC ..... *F25C 1/00* (2013.01); *F25C 5/187* (2013.01)

(58) Field of Classification Search

CPC ..... F25C 1/00; F25C 5/187
USPC ..... 62/137
See application file for complete search history.

(56) References Cited

U.S. PATENT DOCUMENTS

| | | | | |
|---|---|---|---|---|
| 3,382,682 A * | 5/1968 | Frohbieter | F25C 1/04 | 62/137 |
| 5,881,563 A * | 3/1999 | Lee | F25C 1/04 | 62/353 |
| 6,050,097 A * | 4/2000 | Nelson | F25C 5/005 | 62/137 |
| 6,324,855 B1 * | 12/2001 | Mullis | F25C 5/187 | 340/686.6 |
| 6,334,319 B1 * | 1/2002 | Senner | F25C 5/005 | 62/137 |

(Continued)

FOREIGN PATENT DOCUMENTS

| | | |
|---|---|---|
| CN | 1211713 A | 3/1999 |
| CN | 200975815 Y | 11/2007 |

(Continued)

*Primary Examiner* — Henry Crenshaw
(74) *Attorney, Agent, or Firm* — Rabin & Berdo, P.C.

(57) ABSTRACT

Provided is a driving device for an automatic ice-making machine, the driving device including: a cam gear that rotates a tray; and an operating lever that organically operates along a cam plane for an ice-cube quantity detecting arm formed at the cam gear and allows the ice-cube quantity detecting arm to rotate downward into an ice-cube storage bin, wherein a cam groove for the ice-cube quantity detecting arm is formed in the cam plane for the ice-cube quantity detecting arm of the cam gear and allows the operating level to descend so that the ice-cube quantity detecting arm rotates downward into the ice-cube storage bin, and a protrusion is formed between the cam plane for the ice-cube quantity detecting arm and the cam groove for the ice-cube quantity detecting arm and allows the operating lever to ascend so that the ice-cube quantity detecting arm that rotates downward into the ice-cube storage bin rotates upward.

4 Claims, 5 Drawing Sheets

(56) References Cited

U.S. PATENT DOCUMENTS

| | | | | |
|---|---|---|---|---|
| 6,427,456 | B2 * | 8/2002 | Niwa | F25C 5/187 62/137 |
| 2006/0065005 | A1 * | 3/2006 | Comerci | F25C 1/04 62/340 |
| 2010/0319385 | A1 | 12/2010 | Hashimoto | |

FOREIGN PATENT DOCUMENTS

| | | | |
|---|---|---|---|
| CN | 101666569 | A | 3/2010 |
| CN | 101158527 | B | 11/2010 |
| CN | 101929536 | A | 12/2010 |
| JP | 07-218074 | A | 8/1995 |
| JP | 08-110135 | A | 4/1996 |
| JP | 08-313129 | A | 11/1996 |
| JP | 2702874 | B2 | 1/1998 |
| JP | 2003-185312 | A | 7/2003 |
| KR | 10-2012-0030686 | A | 3/2012 |

* cited by examiner

DRIVING DEVICE FOR AUTOMATIC ICE-MAKING MACHINE

CROSS-REFERENCE TO RELATED APPLICATION

This application claims priority to and the benefit of Korean Patent Application No. 10-2012-0024416, filed on Mar. 9, 2012, the disclosure of which is incorporated herein by reference in its entirety.

BACKGROUND

1. Field of the Invention

The present invention relates to a driving device for an automatic ice-making machine, and more particularly, to a driving device for an automatic ice-making machine, whereby a cam gear for rotating a tray is improved, when an ice-cube quantity detecting arm rotates into an ice-cube storage bin, the ice-cube quantity detecting arm is instantaneously shaken in a vertical direction so that freezing of the ice-cube quantity detecting arm can be easily released.

2. Discussion of Related Art

An ice-making machine generally includes a tray compartment in which ice is made, and a driving device that allows ice made in the tray compartment to be automatically deiced by rotating the tray compartment. The driving device rotates an ice-cube quantity detecting arm so as to detect the quantity of ice cubes in an ice-cube storage bin in addition to performing the function of rotating the tray compartment.

Such a driving device for an ice-making machine according to the related art includes a driving motor, a cam gear that rotates by the driving motor, an operating lever that is driven along a first cam plane of the cam gear and allows the ice-cube quantity detecting arm to rotate, and a magnetic lever that is driven along a second cam plane of the cam gear and connects a contact point between the magnetic lever and an hall IC or escapes from the contact point so as to output a signal. Through the above configuration, it can be conveniently detected whether there are ice cubes in the ice-cube storage bin.

However, the driving device for the ice making machine according to the related art is mounted in a refrigerator door. Due to a temperature change caused by opening/closing the refrigerator door, frost is formed on an outer side of the driving device. Due to this frost, the ice-cube quantity detecting arm becomes frozen in a case and does not operate. Thus, there are many requests for repair due to this problem.

Also, the ice-cube quantity detecting arm of the driving device for the ice-making machine according to the related art has a side rotating method. A space in which the ice-cube quantity detecting arm is to rotate, should be formed in sides of the driving device. Thus, there are many difficulties in changing the structure of the driving device.

SUMMARY OF THE INVENTION

The present invention is directed to a driving device for an automatic ice-making machine, whereby the structure of a cam gear for rotating a tray is improved, when an ice-cube quantity detecting arm rotates clockwise, the ice-cube quantity detecting arm is configured to instantaneously rotate counterclockwise, i.e., the ice-cube quantity detecting arm is shaken in a vertical direction so that freezing of the ice-cube quantity detecting arm caused by frost can be conveniently released and thus, a stable operation of the ice-cube quantity detecting arm can be induced.

The present invention is also directed to a driving device for an automatic ice-making machine, whereby an ice-cube quantity detecting arm is improved to swing at a front side of the driving device so that the structure of the driving device can be efficiently changed, and thus can be compactly improved.

According to an aspect of the present invention, there is provided a driving device for an automatic ice-making machine, the driving device including: a cam gear that rotates a tray; and an operating lever that organically operates along a cam plane for an ice-cube quantity detecting arm formed at the cam gear and allows the ice-cube quantity detecting arm to rotate downward into an ice-cube storage bin, wherein a cam groove for the ice-cube quantity detecting arm is formed in the cam plane for the ice-cube quantity detecting arm of the cam gear and allows the operating level to descend so that the ice-cube quantity detecting arm rotates downward into the ice-cube storage bin, and a protrusion is formed between the cam plane for the ice-cube quantity detecting arm and the cam groove for the ice-cube quantity detecting arm and allows the operating lever to ascend so that the ice-cube quantity detecting arm that rotates downward into the ice-cube storage bin rotates upward.

The protrusion may be close to the cam groove for the ice-cube quantity detecting arm so that the ice-cube quantity detecting arm rotates upward and then immediately rotates downward.

A height and a width of the protrusion may be smaller than a depth and a width of the cam groove for the ice-cube quantity detecting arm.

According to another aspect of the present invention, there is provided a driving device for an automatic ice-making machine, the driving device including: a cam gear that rotates a tray; a driving portion that rotates the cam gear downward; an operating lever that organically interlocks along a cam plane for an ice-cube quantity detecting arm and a cam groove for the ice-cube quantity detecting arm that are formed at the cam gear; a spin gear that is disposed between the ice-cube quantity detecting arm and the operating lever so as to transmit power and allows the ice-cube quantity detecting arm to rotate downward into an ice-cube storage bin; and a case in which the cam gear, the driving portion, the operating lever, and the spin gear are placed therein, wherein one end of the spin gear is rotatably disposed in the case and rotates by the operating lever, and the other end of the spin gear protrudes from a front side of the case and allows the ice-cube quantity detecting arm to swing in a horizontal direction when the ice-cube quantity detecting arm is coupled to a center portion of the spin gear.

A protrusion may be formed between the cam plane for the ice-cube quantity detecting arm and the cam groove for the ice-cube quantity detecting arm, and may allow the operating lever to ascend so that the ice-cube quantity detecting arm that rotates downward into the ice-cube storage bin rotates upward.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which:

FIG. 5A illustrates a state in which the operating lever is disposed in a cam plane for an ice-cube quantity detecting arm of the cam gear, FIG. 5B illustrates a state in which the operating lever ascends from a protrusion of the cam gear and the ice-cube quantity detecting arm rotates upward, and FIG. 5C illustrates a state in which the operating lever is inserted into and descends from a cam groove for the ice-cube quantity detecting arm of the cam gear and the ice-cube quantity detecting arm rotates downward.

DETAILED DESCRIPTION OF EXEMPLARY EMBODIMENTS

Figure 1:
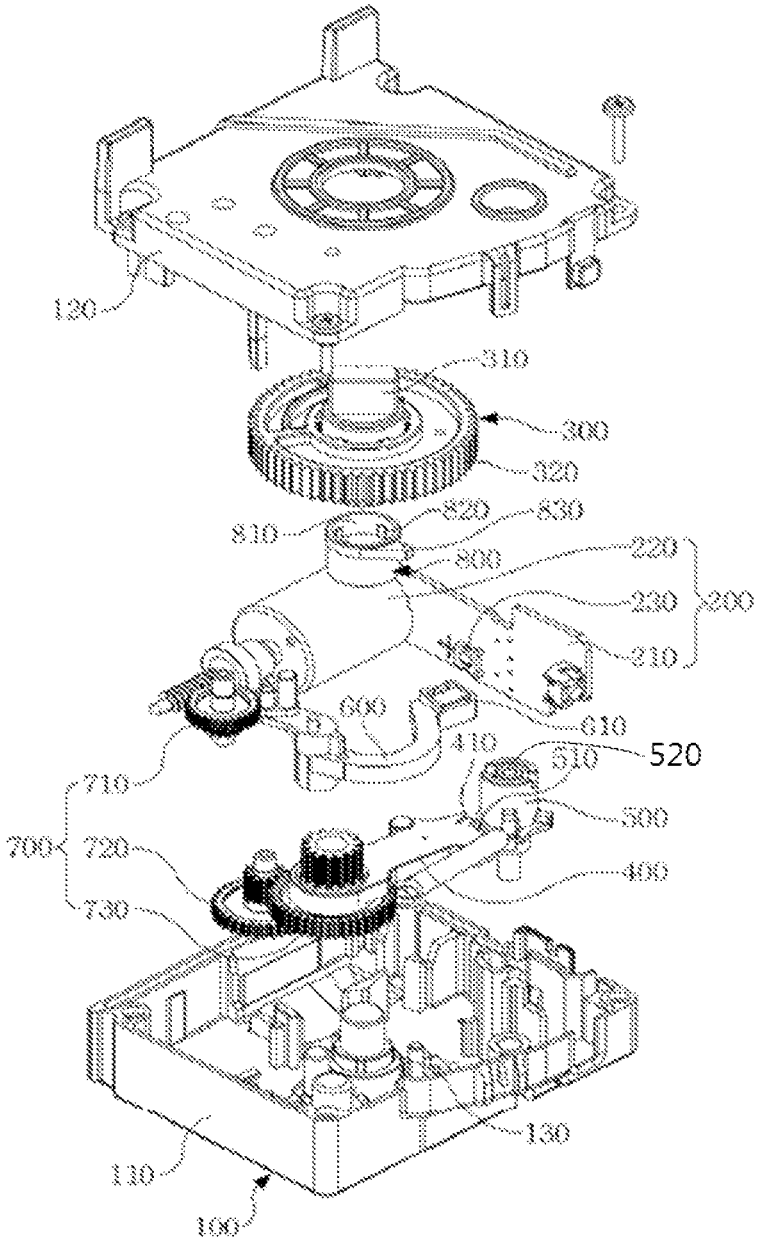
FIG. 1 is an exploded perspective view of a driving device for an automatic ice-making machine according to an embodiment of the present invention.

Exemplary embodiments of the present invention will be described in detail below with reference to the accompanying drawings. While the present invention is shown and described in connection with exemplary embodiments thereof, it will be apparent to those skilled in the art that various modifications can be made without departing from the spirit and scope of the invention. For clarity, portions that have no relation with the description of the present invention are omitted, and like reference numerals refer to like elements throughout.

A driving device for an automatic ice-making machine according to the present invention is configured in such a way that a protrusion is formed between a cam plane for an ice-cube quantity detecting arm that is formed at a cam gear and a cam groove for the ice-cube quantity detecting arm that is formed at the cam gear, an operating lever that organically interlocks along the cam plane for the ice-cube quantity detecting arm is moved in a vertical direction, and the ice-cube quantity detecting arm is instantaneously shaken in the vertical direction, and thus freezing of the ice-cube quantity detecting arm can be easily released.

Figure 2:
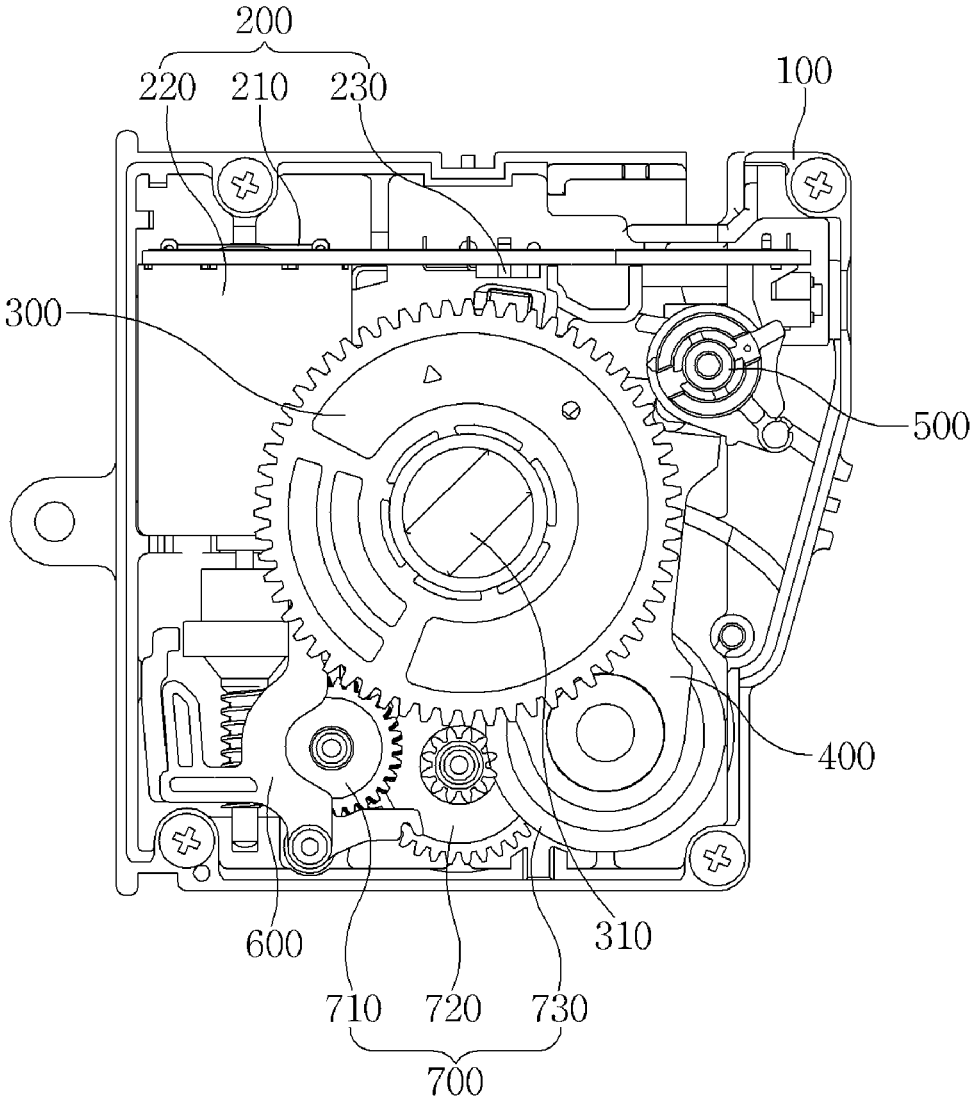
FIG. 2 is a plan view of the driving device for the automatic ice-making machine illustrated in FIG. 1.

The driving device for the automatic ice-making machine having the above configuration includes a driving portion 200, a cam gear 300 that rotates by the driving portion 200 and allows a tray (not shown) to rotate, an operating lever 400 that organically interlocks along a cam plane for an ice-cube quantity detecting arm (see 10 of FIG. 4) of the cam gear 300, a spin gear 500 that rotates by the operating lever 400 and allows the ice-cube quantity detecting arm (see 10 of FIG. 4) to swing in a horizontal direction, a magnetic lever 600 that organically interlocks along a magnetic cam plane of the cam gear 300 and outputs a signal for detecting the quantity of ice cubes or a signal that indicates that an ice cube tray compartment is completely full, and a case 100 in which the driving portion 200, the cam gear 300, the operating lever 400, the spin gear 500 and the magnetic lever 600 are placed therein, as illustrated in FIGS. 1 and 2.

Hereinafter, the configuration of the driving device for the automatic ice-making machine according to the present invention will be described in more detail.

The case 100 of the driving device for the automatic ice-making machine according to the present invention includes a body 110 in which the driving portion 200, the cam gear 300, the operating lever 400, the spin gear 500 and the magnetic lever 600 are placed therein, and a cover 120 that opens or closes the body 110.

The driving portion 200 of the driving device for the automatic ice-making machine according to the present invention includes a control panel 210 that is combined with an inner side of the case 100, a step motor 220 that is disposed at one side of the control panel 210, and a hall IC 230 that is disposed at the other side of the control panel 210. The step motor 220 is connected to the cam gear 300 so as to transmit power, and the hall IC 230 connects a contact point between the magnetic lever 600 and the hall IC 230 or escapes from the contact point so as to output the signal for detecting the quantity of ice cubes or the signal that indicates that the ice cube tray compartment is completely full.

Figure 3:
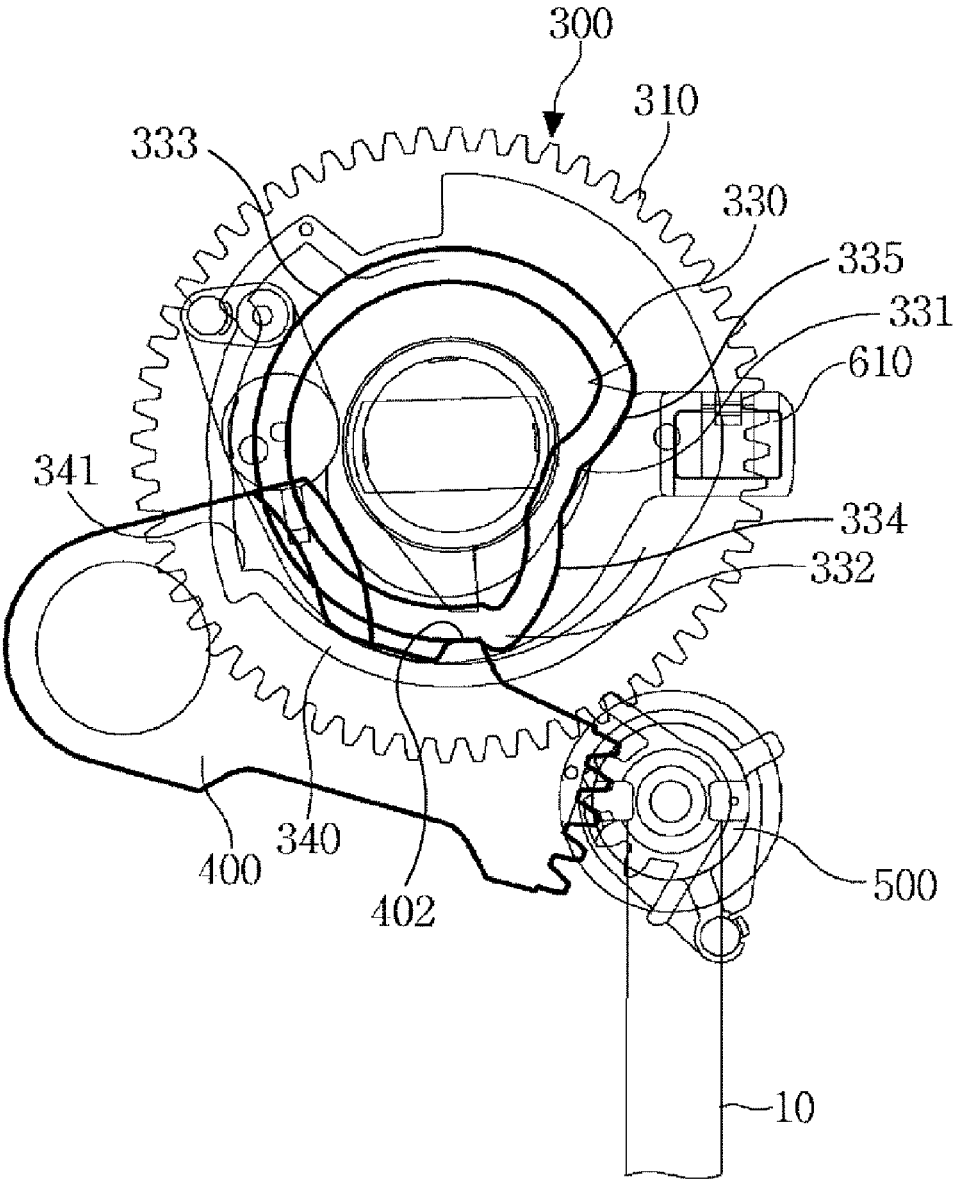
FIG. 3 is a view of a cam gear and an operating lever of the driving device for the automatic ice-making machine of FIG. 1.

The cam gear 300 of the driving device for the automatic ice-making machine according to the present invention includes a coupling portion 310 which is disposed in the middle of the cam gear 300 and to which the tray (not shown) is coupled to be interlocking, a gear portion 320 that is disposed at an outer side of the cam gear 300 and is engaged with the step motor 220 so as to transmit power, and a cam plane 330 for the ice-cube quantity detecting arm (see 10 of FIG. 4) and a magnetic cam plane 340 that are formed at an inner circumferential surface and an outer circumferential surface of the cam gear 300, respectively, as illustrated in FIG. 3.

Here, a cam groove 331 for the ice-cube quantity detecting arm (see 10 of FIG. 4) is formed in the cam plane 330 for the ice-cube quantity detecting arm (see 10 of FIG. 4), and allows the operating lever 400 to descend (to descend in a direction of the coupling portion 310 when viewed from FIG. 3) and to rotate the ice-cube quantity detecting arm (see 10 of FIG. 4) downward into the ice-cube storage bin. A magnetic cam groove 341 is formed in the magnetic cam plane 340, allows the magnetic lever 600 to descend (to descend in an opposite direction to the direction of the coupling portion 310 when viewed from FIG. 3) and to escape from the contact point between the magnetic lever 600 and the hall IC 230.

A deceleration gear 700 is disposed between the cam gear 300 and the step motor 220, decelerates a rotational force of the step motor 220, and transmits the decelerated rotational force to the cam gear 300.

The deceleration gear 700 includes a first deceleration gear 710 that is connected to the step motor 220 to transmit power, a second deceleration gear 720 that is engaged with the first deceleration gear 710, and a third deceleration gear 730 that is connected to the second deceleration gear 720 and the cam gear 300 to transmit power.

The operating lever 400 of the driving device for the automatic ice-making machine according to the present invention has one end inserted into and coupled to a rotation shaft of the third deceleration gear 730 to freely rotate, and the other end in which a gear 410 is connected to the spin gear 500 to transmit power. That is, when the operating lever 400 moves, the spin gear 500 rotates.

Figure 4:
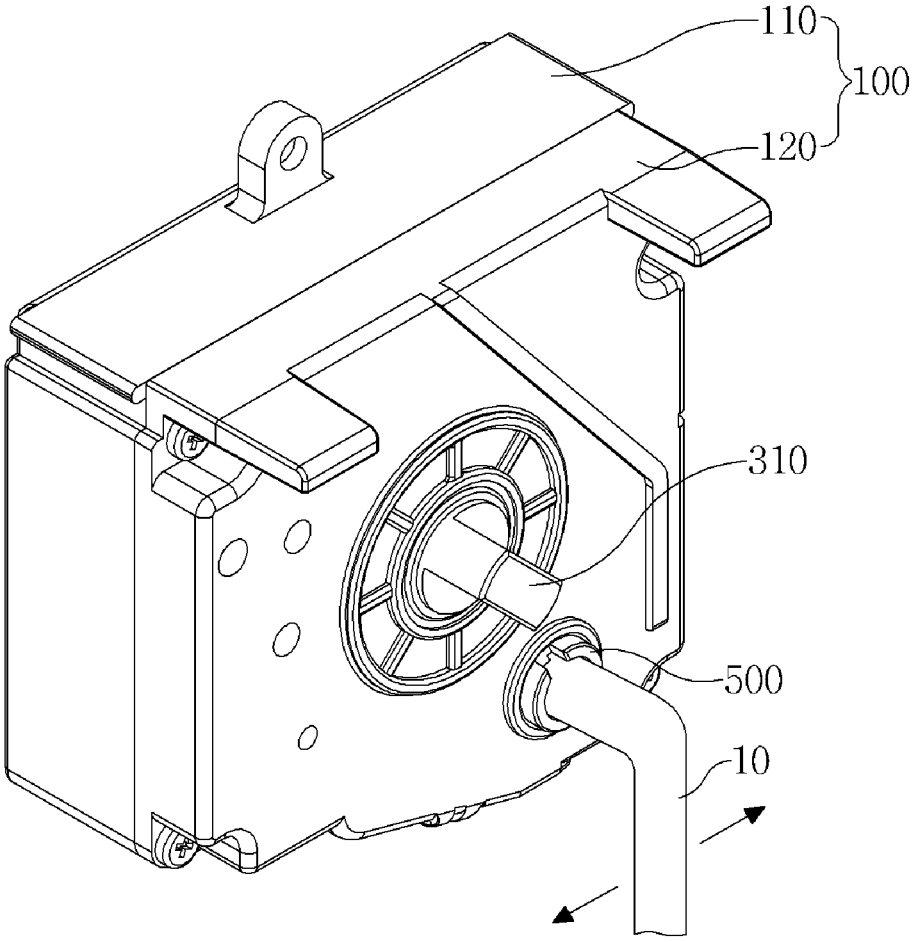
FIG. 4 is an assembling perspective view of the driving device for the automatic ice-making machine of FIG. 1.

The spin gear 500 of the driving device for the automatic ice-making machine according to the present invention has one end connected to an inner side of the case 100 so as to rotate with the operating lever 400, and the other end, which protrudes from the front side of the case 100 and to which the ice-cube quantity detecting arm 10 is coupled to be interlocking, as illustrated in FIG. 4. The ice-cube quantity detecting arm 10 is coupled to a center portion 520 of the spin gear 500.

That is, the spin gear 500 protrudes from the front side of the case 100. Thus, the ice-cube quantity detecting arm 10 can be disposed at the front side of the case 100. As a result, no additional space in which the spin gear 500 is to rotate, is required, and the size of the driving device can be compactly designed.

The magnetic lever 600 of the driving device for the automatic ice-making machine according to the present invention includes a center portion that is rotatably disposed on the bottom surface of the case 100, one end that organically interlocks along the magnetic cam plane 330 of the cam gear 300, and the other end on which a magnet 610 that connects or escapes from a contact point between the magnet 610 and the hall IC 220 is disposed.

That is, when the magnet 610 and the hall IC 220 are maintained in the contact point connected state, the magnetic lever 600 indicates a state in which the quantity of ice cubes is detected, and when the magnet 610 and the hall IC 220 escapes from the contact point, the magnetic lever 600 indicates a state in which the ice cube tray compartment is completely full.

Here, a blocking member 800 is disposed on the rotation shaft of the cam gear 300, and selectively blocks the cam groove 331 for the ice-cube quantity detecting arm 10 so that the operating lever 400 that moves along the cam plane 330 for the ice-cube quantity detecting arm 10 is not inserted into the cam groove 331 for the ice-cube quantity detecting arm 10 when the ice-cube quantity detecting arm 10 is returned to its original position.

That is, the blocking member 800 includes a coupling portion 810 that is rotatably coupled to the rotation shaft of the cam gear 300, a hanging groove 820 that is formed in one side of the coupling portion 810, is coupled to a protrusion 130 formed on the bottom surface of the case 100 and limits a rotation angle of the coupling portion 810, and a support protrusion 830 that is disposed at an outer side of the coupling portion 810, is supported on or escapes from the operating lever 400 when the cam gear 300 rotates clockwise or counterclockwise and limits operation of the operating lever 400 so that the operating lever 400 is not inserted into the cam groove 331 for the ice-cube quantity detecting arm 10.

In the driving device for the automatic ice-making machine having the above configuration according to the present invention, the problem that much frost is formed on the outer side of the case 100, and due to the frost, the ice-cube quantity detecting arm 10 becomes frozen and does not operate is solved.

In order to solve the problem, according to the present invention, the structure of the cam gear 300 is improved to instantaneously shake the ice-cube quantity detecting arm 10 in the vertical direction when the ice-cube quantity detecting arm 10 rotates downward, so that freezing of the ice-cube quantity detecting arm 10 can be conveniently released.

That is, a protrusion 332 is formed between the cam plane 330 and the cam groove 331 for the ice-cube quantity detecting arm 10 of the cam gear 300 according to the present invention, and allows the ice-cube quantity detecting arm 10 that rotates downward into the ice-cube storage bin to instantaneously rotate upward so that the ice-cube quantity detecting arm 10 can be shaken in the vertical direction.

Figure 5:
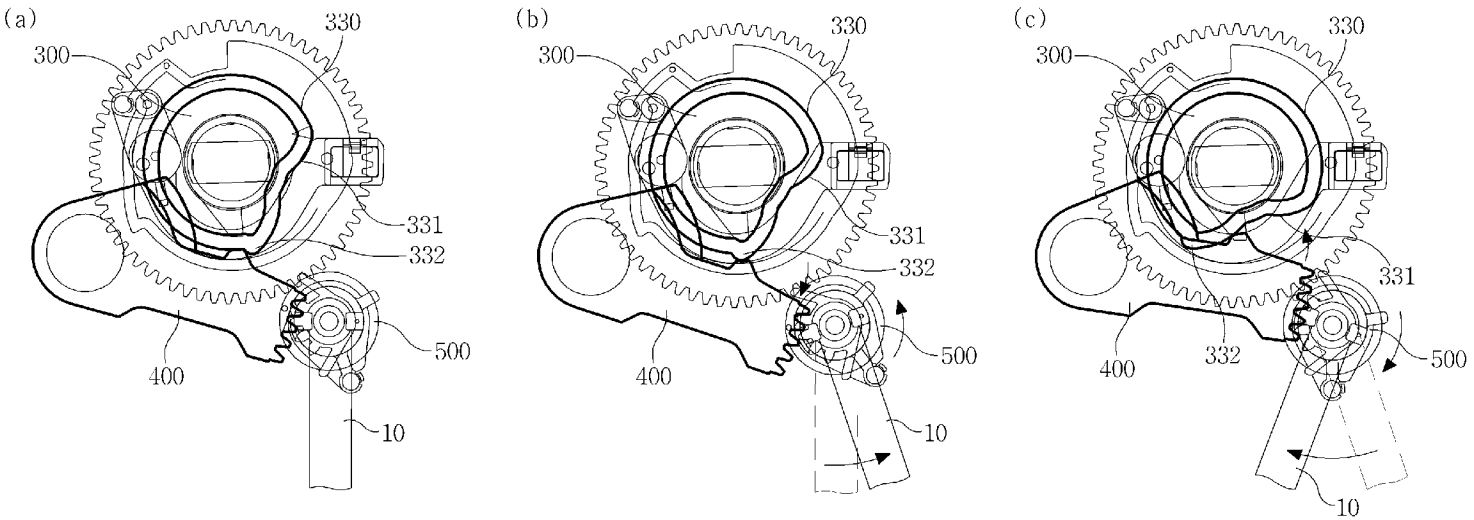
FIGS. 5A through 5C illustrate an operating state of the driving device for the automatic ice-making machine of FIG. 1, in detail.

That is, the protrusion 332 is formed between the cam plane 330 and the cam groove 331 for the ice-cube quantity detecting arm 10, and protrudes outward in a semicircular form, as illustrated in FIGS. 5A through 5C. When the operating lever 400 goes over the semicircular protrusion 332, the operating lever 400 ascends instantaneously and then descends. As the operating lever 400 ascends or descends, the spin gear 500 instantaneously rotates upward and then rotates downward, and freezing of the ice-cube quantity detecting arm 10 can be released by an operating force that is generated when the ice-cube quantity detecting arm 10 is instantaneously shaken in the vertical direction by interlocking with the spin gear 500.

That is, the effect of shaking the ice-cube quantity detecting arm 10 in the vertical direction once due to the protrusion 332 can be obtained, and freezing of the ice-cube quantity detecting arm 10 can be easily and conveniently released by the shaking effect.

As described above, in a driving device for an automatic ice-making machine according to the present invention, the protrusion is formed between the cam plane for the ice-cube quantity detecting arm of the cam gear and the cam groove for the arm so that the operating lever can instantaneously rotate upward and then can rotate downward. Thus, the effect of shaking the ice-cube quantity detecting arm in a vertical direction can be obtained so that freezing of the ice-cube quantity detecting arm can be conveniently and efficiently released, and thus no additional repair work is required.

In addition, in the driving device for the automatic ice-making machine according to the present invention, the spin gear is disposed at the front side of the case so as to swing the ice-cube quantity detecting arm in a horizontal direction so that the driving device for the automatic ice-making machine can be more compactly designed.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. A driving device for an automatic ice-making machine, the driving device comprising:

a rotatable cam gear that includes a rotatable cam plane configured to rotate about an axis in a rotation direction and a coupling portion to which a tray is coupled so that the cam gear rotates the tray, the cam plane including a first surface, a protrusion connected to the first surface, and a cam groove including a first portion adjacent to the protrusion and configured to extend obliquely toward the axis from the protrusion, and a second portion connected between the first portion and the first surface, and an operating lever including a rotatably fixed end portion, and a contact portion distally spaced from the rotatably fixed end portion and arranged to be in contact with the cam plane, and the operating lever being configured to control movement of an ice cube quantity detection arm in response to rotation of the cam plane, the ice cube quantity detecting arm having a pivotally fixed end and an opposite end, the opposite end being positioned in an ice-cube storage bin when the ice cube quantity detecting arm is in an original position, the operating lever being operably connected to the pivotally fixed end of the ice cube quantity detecting arm, wherein when the cam plane rotates in the rotation direction, and the contact portion engages and passes over the first surface, the ice cube quantity detecting arm remains in the original position, wherein when the cam plane further rotates in the rotation direction, and the contact portion engages and passes over the protrusion the protrusion actuates the operating lever to first move the ice-cube quantity detecting arm in a first pivotal direction to move the opposite end upward and then moves the ice cube quantity detecting arm in a second pivotal direction, opposite the first pivotal direction, to move the opposite end downward for returning the ice cube quantity detecting arm back to the original position, wherein when the cam plane further rotates in the rotation direction, and the contact portion engages and passes over the first portion the first portion actuates the operating lever to move the ice-cube quantity detecting arm in the second pivotal direction to thereby move the opposite end downward into the ice-cube storage bin, and wherein when the cam plane further rotates in the rotation direction, and the contact portion engages and passes over the second portion the second portion actuates the operating lever to move the ice-cube quantity detecting arm in the first pivotal direction to move the opposite end upward until the ice cube quantity detecting arm moves back to the original position.

2. The driving device of claim 1, wherein a height of the protrusion and a length of the protrusion in a circumferential direction of the cam plane are respectively smaller than a depth of the cam groove and a length of the cam groove in a circumferential direction of the cam plane.

3. A driving device for an automatic ice-making machine, the driving device comprising:

a cam gear that includes a cam plane configured to rotate about an axis in a rotation direction, the cam plane including a first surface, and a cam groove including a first portion adjacent to the first surface and extending obliquely toward the axis from the first surface, and a second portion connected between the first portion and the first surface, and a coupling portion to which a tray is coupled so that the cam gear rotates the tray;

a driving portion that rotates the cam gear;

an operating lever including a rotatably fixed end portion, and a contact portion distally spaced from the rotatably fixed end portion, and arranged to be in contact with the cam plane and to operate along the cam plane, a spin gear that operably connects the operating lever to an ice-cube quantity detecting arm, the ice cube quantity detecting arm having a pivotally fixed end and an opposite end, the opposite end being positioned in an ice-cube storage bin when the ice cube quantity detecting arm is in an original position; and a case in which the cam gear, the driving portion, the operating lever and the spin gear are placed, wherein the spin gear has two ends, one end of which is disposed in the case and configured to be rotated by the operating lever, and the other end of which protrudes out of the case and is connected to the pivotally fixed end of the ice-cube quantity detecting arm such that the ice-cube quantity detecting arm swings on a plane parallel to the front side of the case when the ice-cube quantity detecting arm is coupled to a center portion of the spin gear, wherein when the cam plane rotates in the rotation direction, and the contact portion engages and passes over the first surface, the ice cube quantity detecting arm remains in the original position, wherein when the cam plane further rotates in the rotation direction, and the contact portion engages and passes over the first portion the first portion actuates the operating lever to move the ice-cube quantity detecting arm in a pivotal direction to thereby move the opposite end downward into the ice-cube storage bin, and wherein when the cam plane further rotates in the rotation direction, and the contact portion engages and passes over the second portion the second portion actuates the operating lever to move the ice-cube quantity detecting arm in another pivotal direction, opposite to the pivotal direction, to move the opposite end upward until the ice cube quantity detecting arm moves back to the original position.

4. The driving device of claim 3, wherein the cam plane further includes a protrusion that protrudes away from a center of rotation of the cam plane, the protrusion being formed between the first surface and the first portion, wherein when the cam plane rotates in the rotation direction, and the contact portion engages and passes over the protrusion the protrusion actuates the operating lever to first move the ice-cube quantity detecting arm in said another pivotal direction to move the opposite end upward and then moves the ice cube quantity detecting arm in said pivotal direction to move the opposite end downward for returning the ice cube quantity detecting arm back to the original position.

* * * * *